US006966069B2

(12) United States Patent
Booth

(10) Patent No.: US 6,966,069 B2
(45) Date of Patent: Nov. 22, 2005

(54) TRAVEL BLANKET WITH ARM SUPPORT

(75) Inventor: Arlen L. Booth, P.O. Box 147, Henry, IL (US) 61537

(73) Assignee: Arlen L. Booth, Henry, IL (US)

( * ) Notice: Subject to any disclaimer, the term of this patent is extended or adjusted under 35 U.S.C. 154(b) by 0 days.

(21) Appl. No.: 10/837,258

(22) Filed: Apr. 30, 2004

(65) Prior Publication Data

US 2004/0237196 A1 Dec. 2, 2004

Related U.S. Application Data

(60) Provisional application No. 60/467,187, filed on May 1, 2003.

(51) Int. Cl.[7] ..... A41D 3/08

(52) U.S. Cl. ..... 2/69; 2/48; 2/69.5; 2/88; 5/485

(58) Field of Search ..... 2/88, 48, 69.5, 2/69, 51, 50, 49.1–49.5, 46, 47, 91, 52, 83, 2/84, 89, 94, 104, 114, 247, 248, 253, 80; 5/485, 482, 494; D2/823, 824, 826, 860, D2/861, 863, 864

(56) References Cited

U.S. PATENT DOCUMENTS

| | | | | | |
|---|---|---|---|---|---|
| 197,346 | A | * | 11/1877 | Denneler | 2/88 |
| 310,309 | A | * | 1/1885 | Pick | 2/65 |
| 569,521 | A | * | 10/1896 | Scatchard | 2/69.5 |
| 1,370,009 | A | * | 3/1921 | Ehrenberg | 128/873 |
| 2,362,465 | A | * | 11/1944 | Carner | 2/49.4 |
| 2,457,725 | A | * | 12/1948 | Rhowmine | 2/49.5 |
| 2,967,306 | A | | 1/1961 | Fabanich | |
| 3,381,306 | A | | 5/1968 | Innes | |
| 3,522,612 | A | | 8/1970 | Palmer | |
| 3,958,274 | A | | 5/1976 | Klauber | |
| 4,171,542 | A | * | 10/1979 | Cox et al. | 2/51 |
| 4,370,755 | A | | 2/1983 | Crumby | |
| 4,484,362 | A | | 11/1984 | Asher | |
| 4,752,971 | A | | 6/1988 | Meserol | |
| 5,146,625 | A | | 9/1992 | Steele et al. | |
| 5,410,758 | A | * | 5/1995 | Dupont et al. | 2/51 |
| 5,437,061 | A | | 8/1995 | Kenner | |
| 5,463,783 | A | | 11/1995 | Pope | |
| 5,657,489 | A | | 8/1997 | Ponstein | |
| 5,692,238 | A | | 12/1997 | Watson, Jr. | |
| 5,884,331 | A | | 3/1999 | Barajas | |
| 5,893,171 | A | * | 4/1999 | Ries | 2/48 |
| 5,946,723 | A | | 9/1999 | DiPrato et al. | |
| 6,000,056 | A | * | 12/1999 | Brady et al. | 2/49.1 |
| 6,014,772 | A | | 1/2000 | Connelly | |
| 6,021,521 | A | * | 2/2000 | Baratta | 2/49.1 |
| 6,185,743 | B1 | * | 2/2001 | Mick | 2/84 |
| 6,219,847 | B1 | * | 4/2001 | Aikins | 2/69 |
| 6,237,150 | B1 | * | 5/2001 | Lucas | 2/49.1 |
| 6,275,993 | B1 | | 8/2001 | McCarley | |
| 6,353,933 | B1 | | 3/2002 | Love | |

(Continued)

*Primary Examiner*—A. Vanatta

(57) ABSTRACT

A travel blanket having a head hole through which a traveler can extend the traveler's head. A rear portion drapes down over the traveler's back and shoulders and a front portion covers the traveler's chest and torso. A pocket is positioned along the interior of the front portion for supporting the traveler's arms when the traveler's arms are positioned therein.

14 Claims, 3 Drawing Sheets

U.S. PATENT DOCUMENTS 6,393,637 B1 5/2002 Hoffman
6,401,248 B1 6/2002 Christensen
6,435,185 B1 8/2002 Schimpl
6,643,870 B2 11/2003 Bertrand
2002/0124850 A1 9/2002 Schimpl
2002/0129445 A1 9/2002 Deering et al.
2003/0061659 A1 4/2003 Dunlap et al.
2004/0205876 A1 * 10/2004 Bruffett ..... 2/49.2

* cited by examiner

TRAVEL BLANKET WITH ARM SUPPORT

RELATED APPLICATIONS

This application claims the benefit of U.S. Provisional Application No. 60/467,187 filed May 1, 2003.

BACKGROUND

Travelers have long used blankets for warmth and comfort during trips on all types of transportation including buses, airplanes, and trains. Often, such blankets slip out of position such as by slipping down the traveler's body causing annoyance to the traveler. It is desirable to have a travel blanket that is comfortably worn and that stays in place.

Also, while sleeping on the bus, train, or other form of transportation, the traveler may inadvertently shift their arms out from underneath the blanket, and then hit or otherwise touch a neighboring passenger. Such movement may not only awaken the blanket-wearing traveler, but may also cause a conflict with the neighboring traveler. It is therefore desirable to have a simple, low cost travel blanket that can comfortably support and store the traveler's arms during a trip.

SUMMARY

Briefly, and in accordance with the foregoing, disclosed is a travel blanket with arm support for use by a traveler on a trip. The travel blanket includes a front portion, a rear portion, and a head hole positioned along an axis connecting the front portion and the rear portion. The front portion has an outer surface and an inner surface, the inner surface having at least one interior pocket for storing a traveler's arms. When worn, the bottom edges of the front and rear portions define an open bottom end through which the traveler's lower torso and/or legs can extend. When the blanket is used during travel, the open bottom end is an important safety feature since during an emergency it ensures that the passenger is free to rise from the seated position without being encumbered by the blanket.

A lining of the head hole may be formed from an elastic material for comfort and to allow for stretching caused by the weight of the traveler's arms. Such an arrangement makes the travel blanket more comfortable to wear for extended periods as the weight of the traveler's arm may be more efficiently spread around the head hole area. The rear portion of the blanket may be dimensioned to cover the upper portion of the back and shoulders of a traveler. These two design features of the travel blanket allow the traveler to wear it in comfort for prolonged periods of time without the necessity of providing straps or buckles to carry the weight of the arms. Also, a number of outer pockets may also be formed on the outer surface of the front portion for storage of the traveler's items such as tissue, glasses, a cell phone, or other portable electronic device.

Additional features will become apparent to those skilled in the art upon consideration of the following detailed description of drawings exemplifying the best mode as presently perceived.

BRIEF DESCRIPTION OF THE DRAWINGS

The detailed description particularly refers to the accompanying figures in which.

DETAILED DESCRIPTION

Figure 1:
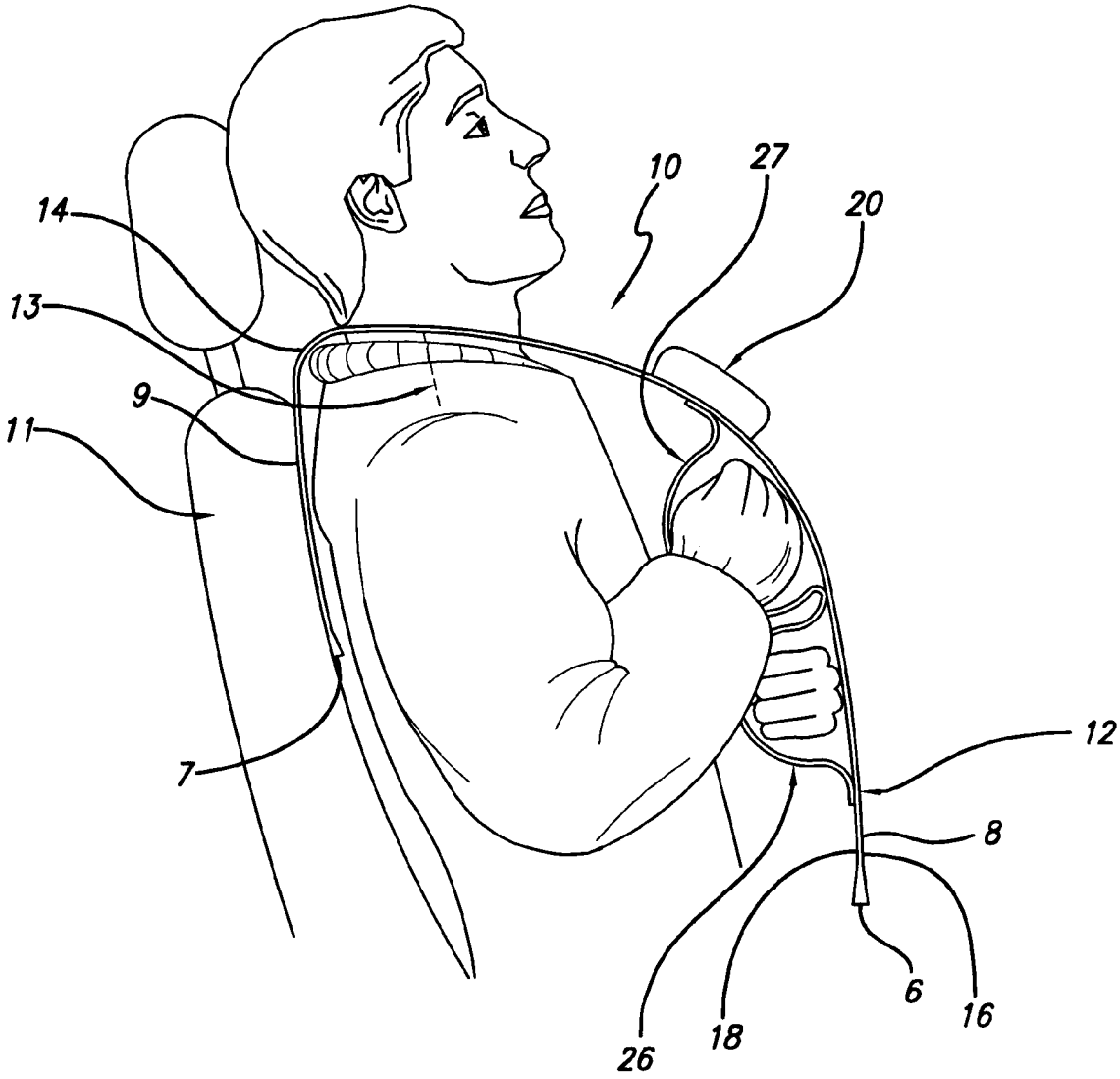
FIG. 1 is a simplified side view of a travel blanket being worn by a person while seated.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

Figure 2:
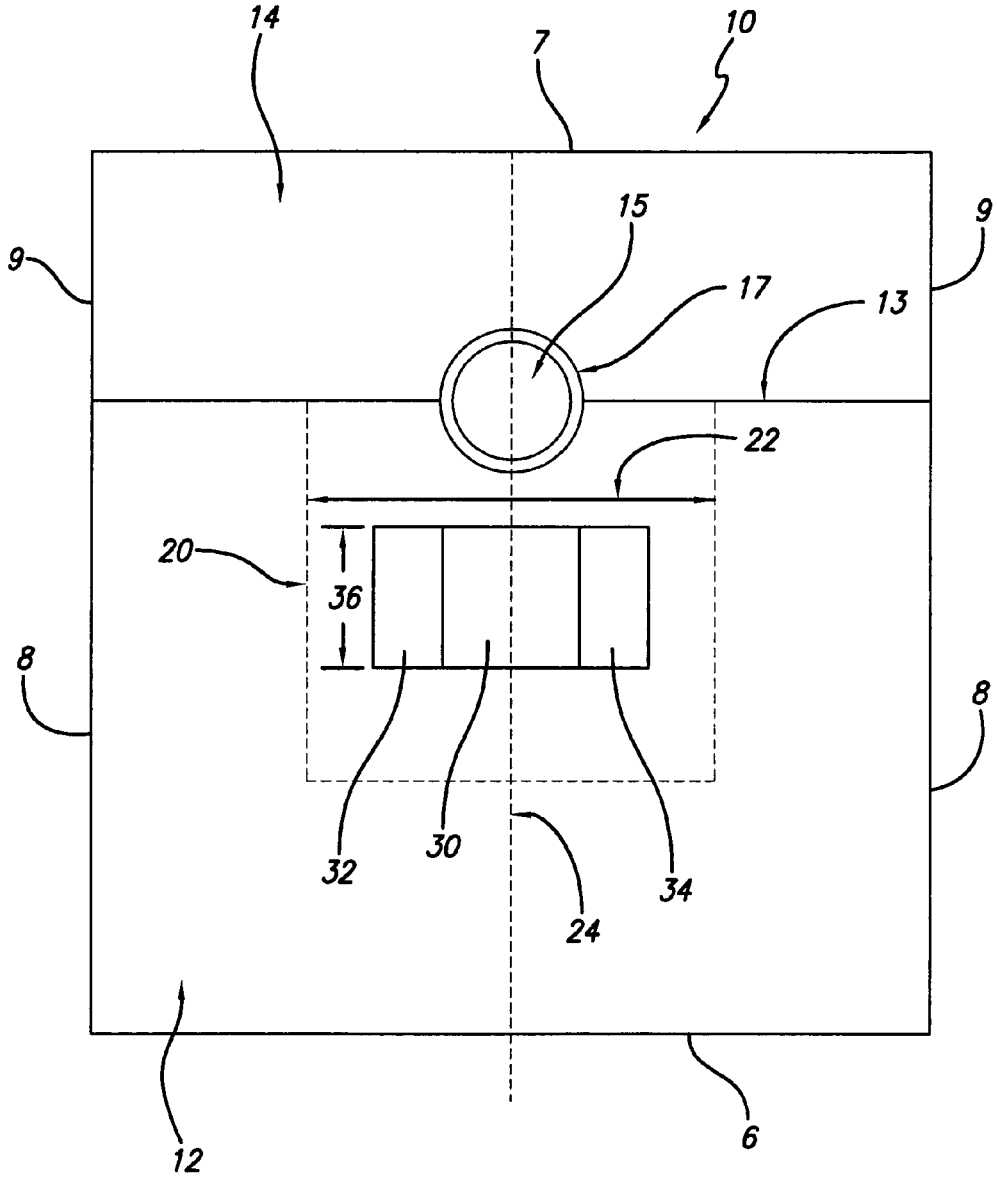
FIG. 2 is a top plan view of the travel blanket of FIG. 1.

With reference to the figures, FIG. 1 is a simplified line drawing showing a travel blanket 10 worn by a traveler while sitting in a seat 11. Travel blanket 10 is a sheet made from a fabric, plastic, man-made material, or other flexible material suitable for being formed into a sheet, that includes a front portion 12 which covers the front of the traveler's body and a rear portion 14 which is dimensioned to cover the top portion of the traveler's back and/or shoulders and to be trapped between the seat 11 and the traveler when the traveler is seated. It is desirable to have the rear portion 14 trapped between seat 11 and traveler's back because this arrangement relieves some of the stress on the fabric due to the weight of the traveler's arms thereby preventing the fabric from over-stretching and also to spread the load to avoid placing too much strain on the traveler's neck area. The sheet has a top edge 7, a bottom edge 6, and two opposing side edges. Each edge is divided into a front edge 8 and a rear edge 9. The front and rear portions 12, 14 are divided at an axis or transverse line 13 as shown in FIG. 2. Front portion 12 is generally defined by bottom edge 6, axis 13, and opposing front side edges 8. Rear portion 14 is generally defined by top edge 7, axis 13 and opposing rear side edges 9.

The travel blanket 10 includes an opening or a head hole 15 through which the traveler's head extends when the travel blanket 10 is worn. Head hole 15 is generally positioned along transverse line 13 approximately midway between the opposing side edges 8, 9. Head hole 15 and transverse line 13 generally are spaced a fraction of the total length of travel blanket 10 away from top edge 7, such as from approximately ⅓ to approximately ¼ of the distance between top edge 7 and bottom edge 6. Head hole 15 may include a lining or ribbing 17 formed from a soft, resilient material to provide for a degree of stretching. The use of a resilient material around the head hole has the benefit of increasing the comfort of the traveler when putting on or taking off the blanket and of spreading the force away from the neck area when the traveler's arms are placed inside the travel blanket 10. A generally circular or rounded head hole 15, as illustrated in FIG. 2, may have advantages over a head slit because a slit design may cause pressure points along the neck area when worn for extended periods and is less comfortable to put on and remove, although a slit may be used as well.

Figure 3:
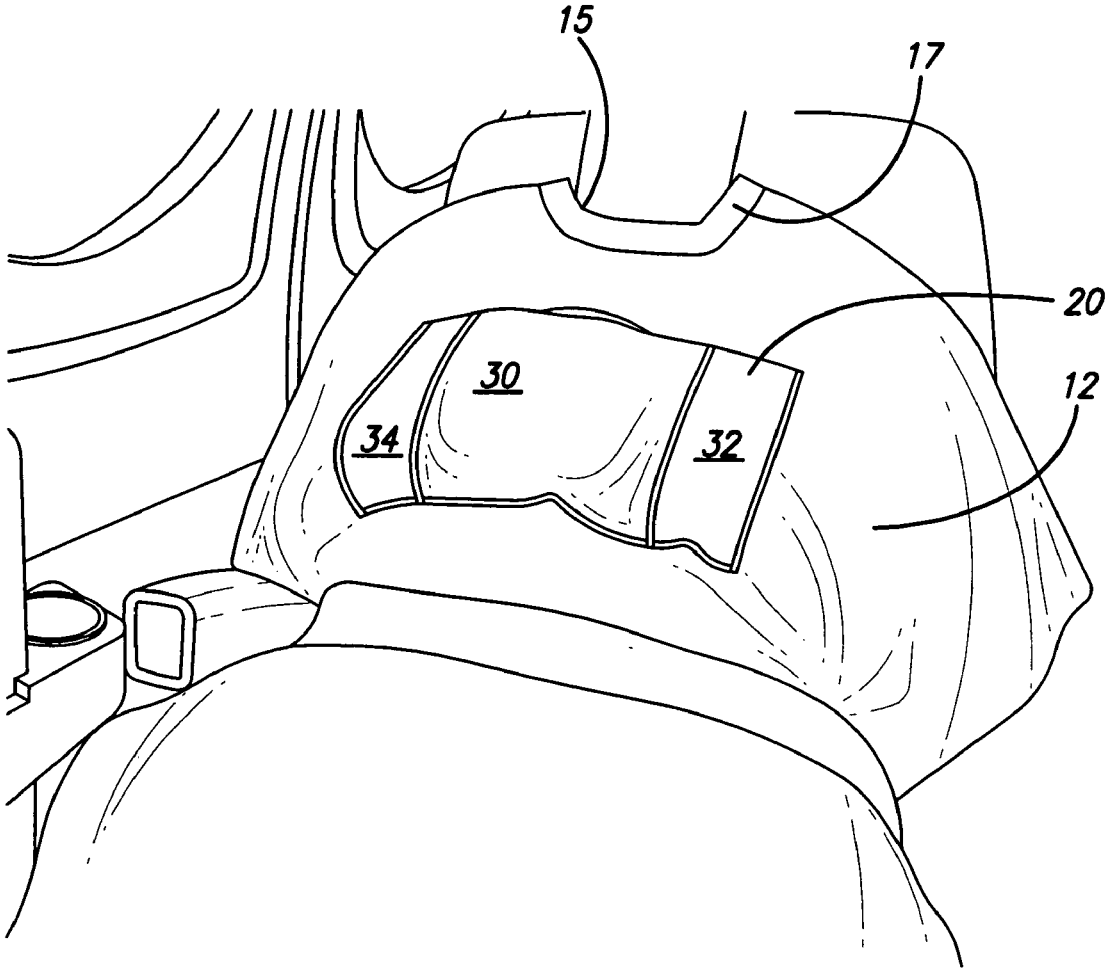
FIG. 3 is a view of the travel blanket being worn by a person who is buckled into an airplane seat.

The front portion 12 has an outer surface 16 and an inner surface 18. The outer surface 16 may include an outer pocket portion 20. Outer pocket portion 20 has a width 22 extending over a portion of the outer surface 16 in both directions from a center axis 24. Outer pocket portion 20 may consist of one pocket or may be divided into a number of pockets. As shown in FIGS. 2–3, one embodiment of outer pocket portion 20 has divisions to form a larger center pocket 30 and two side pockets 32, 34. This embodiment is one example of the size and quantity of pockets that outer pocket portion 20 may have. Other sizes and quantities of pockets, such as for example, two equal size pockets or four or more pockets may be used as well. The pockets 30, 32, 34 have a depth 36 that allows for convenient storage of travel items such as glasses, tissue, a CD-player, cell phone, or other portable electronic device.

As shown in FIG. 1, interior surface 18 includes one or more arm interior pockets. Although two interior pockets are shown, travel blanket 10 may include just one interior pocket. Lower interior pocket 26 and upper interior pocket 27 generally run lengthwise across the traveler's chest or front torso generally parallel to the axis 13 and have a length generally proportional to outer pocket portion width 22. Upper interior pocket 27 is at least partially above lower interior pocket 26. Interior pockets 26, 27 may have a variety of forms including being generally tubular with an opening at both ends. Alternatively, interior pockets 26, 27 may be open at only one end to each allow entry of only one arm.

Interior pockets 26, 27 are used to support the traveler's arms when the arms are positioned therein. The traveler may place one arm in lower interior pocket 26 and the other arm in upper interior pocket 27, or may reverse this arrangement. The traveler may also place both arms in one interior pocket 26 or 27 if that positioning is more comfortable for the traveler. For example, a taller person may have longer arms and feel more comfortable positioning both arms in lower pocket 26. Additional interior pockets of varying heights may be included along interior surface 18 to provide a traveler with a selection of support positions.

FIG. 3 is a view of one embodiment of the travel blanket 10 showing the location of the outer pockets 30, 32, 34.

In one embodiment, travel blanket 10 is formed and has dimensions as described hereinafter. Travel blanket 10 is a 44.88 inch×41.75 inch fleece material consisting of 65% polyester and 35% cotton. The rear portion 14 is made from the same fleece material and has dimensions 12 inch×41.75 inch. The front portion 12 is made from the same fleece material and has dimensions 32.88 inch×41.75 inch and includes sewn in outer pocket portion 20. Head hole 15 is 7 inches in diameter and includes sewn in ribbing around the opening. A combination of straight stitching and serge stitching may be used.

The materials and dimensions described above represent one embodiment and do not limit other configurations for the travel blanket 10. For example, all dimensions may be scaled down when the travel blanket 10 is intended for use by children or scaled up for taller people. Other materials or material combinations other than a polyester-cotton blend may be used as well.

In use, a traveler puts on the travel blanket 10 by pulling the front and/or rear portions 12, 14 down over the traveler's body as the traveler's head extends through head hole 15. The sides of the front portion 12 may be tucked around the traveler's sides and behind the traveler for additional warmth and comfort. Travel items may be placed in the pockets of the outer pocket portion 20. As described above, the traveler positions his or her arms into the interior pocket or pockets 26, 27 to support the arms during rest or sleep. This helps prevent the traveler from accidentally elbowing or hitting a neighboring traveler during sleep.

The weight of the traveler's arms may cause some stretching at head hole 15. The rear portion 14 being dimensioned to be trapped behind the traveler along with the flexibility of the head hole lining 17 helps prevent this stretching from putting excessive pressure on the traveler's neck. In the embodiment of the disclosure shown in FIG. 1, the use of a flexible head hole lining 17, and rear portion 14 dimensioned to be trapped behind the traveler, spreads the force of the arms hanging within interior pockets 26, 27 to ensure that the blanket 10 may be worn comfortably for an extended period. This simple construction of the blanket 10 provides a high level of comfort at low cost since additional straps and buckles may not be needed to support the weight of the traveler's arms.

At all times, the traveler's legs or lower torso extend beyond the bottom edges of the front and rear portions 10, 12. The travel blanket 10 can thus be said to have an open bottom end between top edge 7 and bottom edge 6 when travel blanket 10 is draped over the traveler and thus both top and bottom edges 7, 6 generally pointing downwardly. This allows easy access to the traveler's feet area and allows the traveler to get up and out of the seat quickly without obstruction from the travel blanket 10 in case of an emergency.

The travel blanket 10 is removed by lifting the front or rear portions 12, 14 up over the traveler's head until the head is removed from the head hole 15. In the embodiment of FIG. 2, the provision of a rounded, head hole 15 with flexible hole liner 17 improves the comfort of this operation.

Although the disclosure provided above describes use of the travel blanket 10 by a traveler during a trip, the blanket 10 can also be used by any person desiring the warmth and comfort of a blanket while simultaneously having their arms supported. Other examples include a person wearing the blanket 10 while watching television, or an elderly or handicapped person wearing the blanket 10 while sitting in a wheel chair.

While this disclosure has been described as having exemplary embodiments, this application is intended to cover any variations, uses, or adaptations using the general principles set forth herein. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

What is claimed is:

1. A travel blanket for covering a person while in a seated position, the travel blanket comprising:

a fibrous sheet having a top edge, bottom edge, and two opposing side edges, the fibrous sheet further including an axis extending between the opposing side edges, the axis being generally closer to the top edge than the bottom edge, the axis dividing the two opposing side edges into front opposing side edges and rear opposing side edges;

an elastomeric opening positioned along the axis and surrounded by the fibrous sheet, the elastomeric opening adapted to be stretched to allow positioning of the elastomeric opening of the travel blanket over the head and around the neck of the person;

a front portion defined by the bottom edge, the axis, and the front opposing side edges, the front portion having an interior surface and an exterior surface, wherein the front portion of the fibrous sheet covers the arms and the upper portion of the legs of the person when in the seated position;

a first interior pocket positioned on the interior surface of the front portion of the fibrous sheet and adapted to accept a first hand and a portion of the forearm of the person;

a second interior pocket positioned on the interior surface of the front portion of the fibrous sheet, adjacent the first interior pocket and adapted to accept a second hand and a portion of the forearm of the person wherein the hands are adjacent the vertical centerline of the person and the forearms of the person are oriented substantially parallel to one another when the persons hands are inserted into the interior pockets, and a rear portion defined by the top edge of the fibrous sheet, the axis, and the rear opposing side edges, the rear portion extending a length from the axis suitable for trapping the rear portion between the person's upper back and a back portion of a seat when the person is in the seated position.

2. The travel blanket of claim 1, further comprising an open bottom end located between the top edge and bottom edge when the travel blanket is draped over the person.

3. The travel blanket of claim 1, wherein the elastomeric opening includes an elastic lining.

4. The travel blanket of claim 3, further comprising the elastic lining being formed from sewn-in ribbing.

5. The travel blanket of claim 3, further comprising the elastomeric opening being positioned a fraction of a distance from the top edge to the bottom edge.

6. The travel blanket of claim 5, further comprising the fraction being from approximately ⅓ to approximately ¼.

7. The travel blanket of claim 5, further comprising the fraction being approximately ¼.

8. The travel blanket of claim 1, further comprising at least one exterior pocket located on the exterior surface of the front portion.

9. The travel blanket of claim 1, further comprising the interior pocket being positioned at a distance from the elastomeric opening to allow the person's forearms to be supported inside the interior pockets.

10. The travel blanket of claim 1, wherein the first interior pocket is at least partially above the second interior pocket.

11. The travel blanket of claim 1, further comprising the fibrous sheet being formed of a fleece material.

12. A travel blanket for covering a person while in a seated position, the travel blanket comprising:

a fibrous sheet, the sheet having a top edge, bottom edge, and two opposing side edges, the fibrous sheet further including an axis extending between the opposing side edges, the axis being generally closer to the top edge than the bottom edge, the axis dividing the two opposing side edges into front opposing side edges and rear opposing side edges;

an elastomeric opening positioned along the axis and surrounded by the fibrous sheet, the elastomeric opening adapted to be stretched to allow positioning of the elastomeric opening of the travel blanket over the head and around the neck of the person;

a front portion defined by the bottom edge, the axis, and the front opposing side edges, the front portion having an interior surface and an exterior surface, wherein the front portion of the fibrous sheet covers the arms and the upper portion of the legs of the person when in the seated position;

an interior pocket positioned along the interior surface, of the front portion of the fibrous sheet and having two openings, the pocket adapted to accept the hands and a portion of the forearms of the person such that the hands are adjacent the vertical centerline of the person and the forearms of the person are substantially parallel to one another when the persons hands are inserted into the interior pocket; and the interior pocket being positioned to allow the person's left and right forearms to be supported in the interior pocket a rear portion defined by the top edge of the fibrous sheet, the axis, and the rear opposing side edges, the rear portion extending a length from the axis suitable for trapping the rear portion between the person's upper back and a back portion of a seat when the person is in the seated position.

13. A method of using a travel blanket to cover a traveler's shoulders, torso and a portion of the legs when the traveler is positioned within a seat, the method comprising the steps of:

providing a travel blanket, the travel blanket comprising a fibrous sheet, the fibrous sheet having a top edge, bottom edge, and two opposing side edges, an axis extending between the opposing side edges, the axis being generally closer to the top edge than the bottom edge, the axis dividing the two opposing side edges into front opposing side edges and rear opposing side edges, an elastomeric opening positioned along the axis and surrounded by the fibrous sheet, a front portion defined by the bottom edge, the axis, and the front opposing side edges, the front portion having an interior surface and an exterior surface wherein the front portion of the fibrous sheet covers the arms, torso and a portion of the legs of the traveler when in a seated position, a rear portion defined by the top edge, the axis, and the rear opposing side edges, and a pocket positioned along the interior surface of the front portion of the fibrous sheet and having two openings, the pocket adapted to accept the hands and a portion of the forearms of the traveler inserting the head of the traveler through the elastomeric opening; and pulling the travel blanket down over a traveler's torso and legs as the traveler's head extends through the elastomeric opening; and positioning the traveler's hands and a portion of the traveler's forearms into the openings of the pocket so that the hands of the traveler are adjacent the vertical centerline of the traveler and the forearms of the person are substantially parallel to one another, and trapping the rear portion between the traveler's upper back and a back portion of a seat when the person is in the seated position.

14. The method of claim 13, further comprising tucking the opposing front side edges of the front portion between the traveler's torso and a back of a seat.

* * * * *